United States Patent [19]

Smith

[11] Patent Number: 4,690,398

[45] Date of Patent: Sep. 1, 1987

[54] MULTIPURPOSE ROWING APPARATUS

[76] Inventor: Robert S. Smith, 1263 Emory St., San José , Calif. 95126

[21] Appl. No.: 828,317

[22] Filed: Feb. 10, 1986

[51] Int. Cl.[4] ..... A63B 69/06

[52] U.S. Cl. ..... 272/72; 272/130; 272/134

[58] Field of Search ..... 272/72, 73, 126, 127, 272/134, 130; 128/25 R

[56] References Cited

U.S. PATENT DOCUMENTS

| | | | |
|---|---|---|---|
| 304,142 | 8/1884 | Spelman | 272/72 |
| 3,658,327 | 4/1972 | Thiede | 272/72 |
| 3,904,196 | 9/1975 | Berlin | 272/72 |
| 4,452,448 | 6/1984 | Ausherman | 272/72 |
| 4,488,719 | 12/1984 | Brown et al. | 272/72 |

*Primary Examiner*—Richard J. Apley
*Assistant Examiner*—S. R. Crow
*Attorney, Agent, or Firm*—Robert Samuel Smith

[57] ABSTRACT

A rowing machine for exercising in which the ends of a pair of fulcrum bars are attached to the sliding seat and the other ends are equipped with handles. The point of attachment of a resistance means to the fulcrum bars are adjustable. The sliding seat has a back rest. The resistance means is a ram with adjustable check valves.

5 Claims, 5 Drawing Figures

FIG. 1
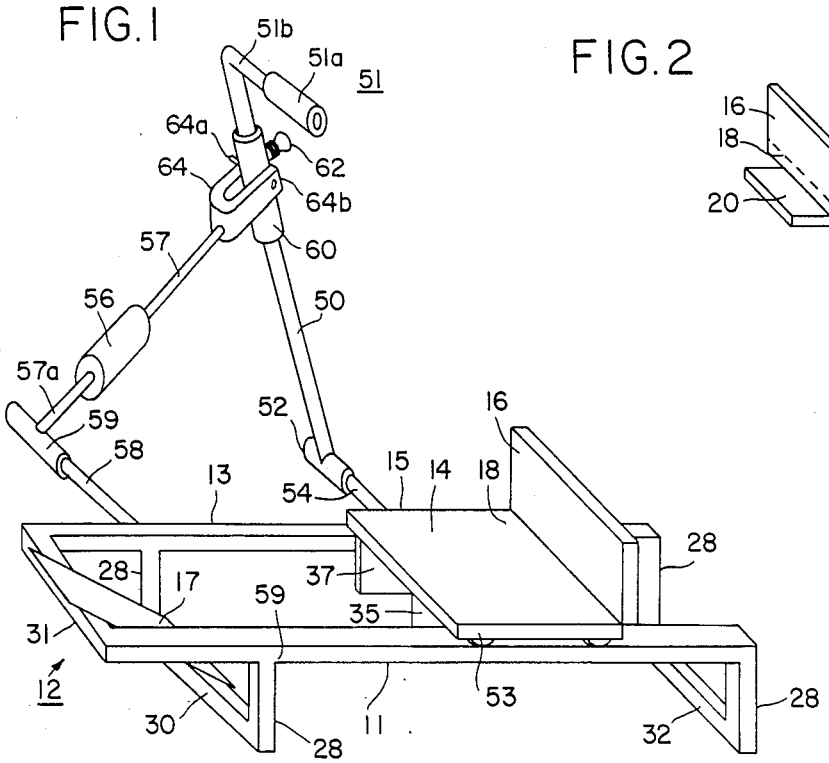
FIG. 2
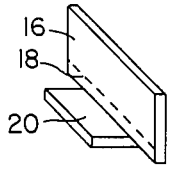
FIG. 3
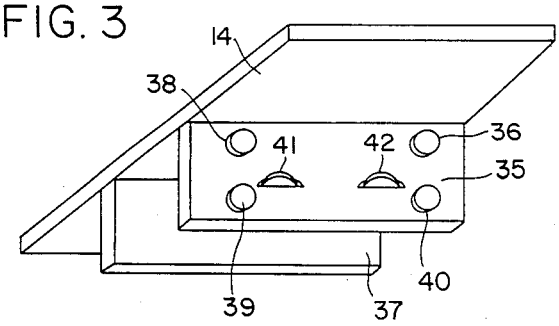
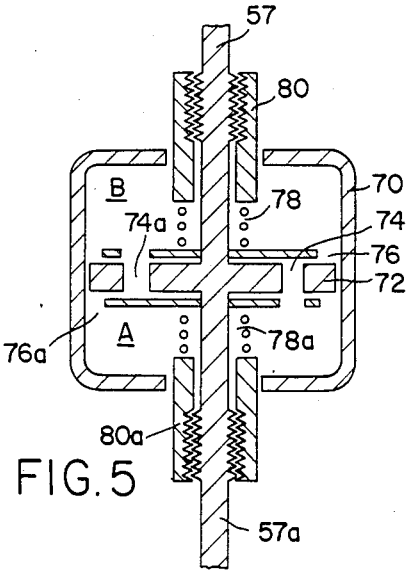
FIG. 5
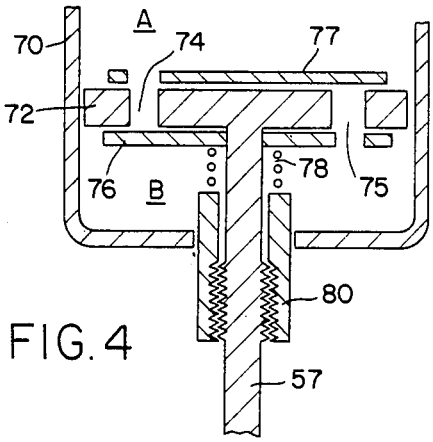
FIG. 4

MULTIPURPOSE ROWING APPARATUS

BACKGROUND OF THE INVENTION:

1. Field of the Invention

This apparatus relates to exercise apparatus and particularly to apparatus for rowing exercises.

2. Prior Art

There are three properties that determine the value of an exercise apparatus:

1. The ability of the apparatus to isolate on a muscle group.

2. The number of muscle groups for which the apparatus can be used.

3. The range of resistance that the apparatus provides.

There are many kinds of rowing machines on the market. One common structural characteristic of these machines is that a seat is provided which rolls on a track. A slanted platform is attached at one end of the track onto which the user places his feet. Handles are provided which the user moves against resistance by straightening his hips, knees and pulling with his arms and shoulders. There are a number of approaches to providing resistance to movement of the handles. According to one design, oars (or fulcrum bars) are attached at fixed fulcrum point attached to each side of the track. A hydraulic ram is attached between a position on the oar and a point on the track near the feet. In another design, the handles are attached to cables leading to springs which are stretched by the rowing movement.

In the exercise of rowing, the user uses muscles of the upper and lower back, the buttocks, the quads, the hamstrings, Since all of these muscle groups are functioning simultaneously, rowing is excellent for conditioning the cardiovaxcular system. However, it is not satisfactory for isolation on a particular muscle group therefore the rowing machines that are presently available are not good "strength" building machines for any of the fore named muscle groups.

Furthermore, there is no means of adjusting the distribution of resistance between the various muscle groups to accomodate the fact that individuals vary with regard to their need or desire to exert upper body force versus lower body force. For example, the ratio of upper body strength to lower body strength is greater for men than it is for women.

Another deficiency with regard to current rowing machines is that the method of applying resistance provides a limited range. When one considers that muscle groups in some ranges of motion require resistances of several hundred pounds whereas other muscle groups require less than 100 pounds, it is apparent that rowing machines currently available are inadequate with respect to available resistance ranges.

In rowing machines of the prior art, resistance is presented to motion of a plunger in the cylinder of a ram by flow of oil through a passage from one side of the plunger to the other side. Variation of resistance is acheived by changing the point of attachment of the ram to the oar. But this design severely limits the resistance presented to straightening the knees and thereby puts most of the stress on the hips and back. Another limitation of this is design is the small range of motion provided.

SUMMARY

It is an object of this invention to provide a rowing machine in which the ratio of force required to pull the oars with the hips and arms to the force required to straighten the knees may be varied.

It is a further objective of this invention to incorporate in the same rowing machine the means to perform leg presses which isolate on the quadriceps.

It is a further object of this invention to incorporate in the rowing machine the means to apply resistance over a larger range and greater distance than is acheived with the prior art.

The apparatus of this invention includes a seat that rolls on a horizontal track, at one end of which is a slanted platform for positioning the feet of the user. A seat is fitted with wheels so that it may roll on the track. A back rest is hinged on the seat edge fartherest from the footrest so that the back may lie horizontally on the seat or it may be positioned erect. When the backrest is erect, a brace rigidly attached to the backrest comes in contact with the underside of the seat so that futher rotation of the backrest away from the seat is prevented.

Near the front edge of the seat on each side, is attached a hinging means to which is fastened one end of a fulcrum bar. On the other end of each fulcrum bar is a handle. In one embodiment the handle is slideably attached to each fulcrum bar. The embodiment may also include a handle which consists of a tube rotatable on a pin which is perpendicular to and slideably attached to the fulcrum bar so that when the user grasps the (tube) handle, he may partially rotate the handle as his wrists turn when he is performing the exercise.

In one embodiment, the means for providing resistance to the performance of the exercise is a ram whose one end is attached near the foot rest and whose other end is slideabley attached to the fulcrum bar so that the distance of the point of attachment to the hinged end of the fulcrum bar may be varied. This variable distance provides the means for adjusting the ratio of force exerted by the arms and back to the force exerted by the quadriceps in performing the rowing motion.

When the attachment for the resistance means is positioned close to or adjacent to the fulcrum bar hinge and the back of the seat is erect, then the user sits with his back against the backrest and he is in a position to perform leg presses.

When the back of the seat is up and the attachment for the resistance means is close to the handle, the user can row without moving his back which is ideal for exercizing the arms.

When the back of the seat is down on the seat and the resistance attachment is distally positioned from both hinge and handle, the user may sit on the back of the seat lying flat on the seat and Perform aerobic rowing exercises involving the legs, back and arms.

When the backsupport is down on the seat, the user may perform situps in which the seat supports the body under the back of the legs rather than under the tailbone so as to protect the lower spine.

It is apparent therefore that the combination of backsupport and adjustable location of the attachnent for the resistance means provides the capability to perform the exercises.

There are numeous ways of providing resistance at the point of attachment to the fulcrum bar and they are all embodiments of this invention.

In one embodiment, the resistance is provided by a ram, being a tube closed at one end with means for hingeable attachment to a point near the footrest. A plunger inside the tube is attached to one end of a rod whose other end is hingeably pinned to a collar which may slide on the fulcrum to a desireable location and then fixed at the selected location as discussed. To provide resistance to motion of the plunger, oil in the tube passes through an orifice in the plunger as the plunger is moved. A variable check valve on the orifice prevents oil from flowing though the orifice unless a preset value of eercise force is applied. The check valve is a flap covering the oil passage in the plunger. The flap is pressed against the orifice opening by a spring with a force determined by a sleeve threaded onto the rod attached to the plunger and protruding from the tube so that it can be manually positioned by turning on the threaded rod.

In another embodiment, resistance is provided by springs attached at one end to a point on the track near the footrest and whose other end is attached to the fulcrum bar as discussed

BRIEF DESCRIPTION OF THE DRAWINGS:

FIG. 1 shows the multipurpose rowing machine where the left oar is not shown.

FIG. 2 shows details of the backrest.

FIG. 3 shows details of the rolling seat.

FIG. 4 shows details of the checkvalve assembly for adjusting resistance in one direction.

FIG. 5 shows details of the checkvalve assembly for adjusting resistance in two directions.

DESCRIPTION OF THE PREFERRED EMBODIMENTS:

Turning now to FIG. 1, there is presented a perspective view of one embodiment of the rowing machine showing the track 12. The track 12 is shown as comprising a right rail 11 and a left rail 13 supported at their ends by vertical legs 28 on the top ends and whose bottom ends are fastened to cross ties 30 and 32 which hold the track together. A third cross bar 31 connecting the end of rail 11 to the end of the other rail 13 supports a slanted panel as foot rest 17. The seat 14 rolls on the track 12. A backsupport 16, shown erect, is hinged along line 18 to fold flat on the seat 14. When the back support 16 is erect, it is stablized by a brace 20 (shown in FIG. 2 attached to the back support 16) which comes into contact with underside of the seat 14 and prevents further rotation of the back support away from the seat.

In FIG. 3 are shown details of the under side of seat 14 which show two roller support panels 35 and 37 (one for each rail and aligned parallel to the rails) which are fastened perpendicularly to the underside of the seat. There is shown on support panel 35 rollers, 36, and 38 which are positioned against the top of rail 11, rollers 39 and 40 are positioned against the bottom of rail 11 and rollers 41 and 42 are positioned against the inside of rail 11. A similar arrangement exists for roller support panel 37 with respect to rail 13.

Referring again to FIG. 1, there is shown a fulcrum bar 50 hingeably attached to the seat 14 by means of collar 52 on a pin 54 positioned horizontally and perpendicular to the rail 11 and attached on one end to the edge 15 of seat 14.

A handle 51 is attached to the other end of fulcrum bar 50. The handle includes a collar **51*a* rotatable on a pin 51*b* attached to the fulcrum bar 50**.

Another fulcrum bar, not shown, is similarly attached on the at position 53 on the opposite side of the seat.

One of a pair of resistance means is shown in FIG. 1 as a hydraulic ram 56 and has one end attached to a collar 59 which may rotate on a horizontal pin 58 perpendicular to and attached to rail 13 near the foot rest. A second resistance means (not shown) is similarly positioned and attached on rail 11 at point 59.

The second end of the ram 56 is a rod 57 pivotally attached to collar 60 which slides on fulcrum bar 50 and is fixed at any desired position by set screw 62. Pivotal attachment is provided by a yoke 64 pinned at its ends by pins **64*a* *l and* 64*b* attached to said collar 60 and attached at its center to rod 57**.

The mechanism to vary the resistance presented by the ram is illustrated in FIG. 4. Here is shown in cross section a tube 70 with a plunger 72 having an orifice 74 through which oil flows from side A to side B of the plunger. Oil will flow only if the pressure is sufficient to open flap 76, forced against the opening of orifice 74 by spring 78. Compression of spring 78 is determined by positioning sleeve 80 which is threaded onto rod 57.

For the return stroke of the plunger 72, oil flows from side B back to side A through orifice 75 past check valve 77.

A similar spring loaded check valve may be positioned on the reverse side of the plunger as illustrated in FIG. 6 if it is desired to control force required for oil flow in both directions. There is shown, in addition to the orifice 74, flap 76, spring 78, and sleeve 80, which control flow of oil through plunger 72 from side A to side B, a corresponding orifice **74*a*, flap 76*a*, spring 78*a* and sleeve 80*a* which control flow from side B to side A of plunger 72**.

It is seen that combining the ram with controllable check valves together with the selected location for attaching the ram to the fulcrum bar achieves the objective in which the ratio of force required to pull the handles of the fulcrum bar by the arms and back to the force required to straighten the knees is independent of the total force of resistance presented by the resistance means. Furthermore, in order to use the machine where the attachment of the resistance means is close to the hingeable attachment of the fulcrum bar to the seat to perform legpresses or to use the machine with the attachment is close to the handles in oder to perform full extension backbends, it is necessary to have the hinged backrest on the seat of this invention. Therefore, the hinged seat, adjustable point of attachment and ram with the adjustable check valves are all interdependent.

To perform the rowing exercise, the user sits on the seat with feet on the foot support and hands grasping each handle at the end of the fulcrum bar. He performs the exercise by straightening his knees and his hips and pulling with his arms as described above.

It will be obvious to one skilled in the art after studying the drawings and descriptions that variations of the above embodiments are possible that are included in the scope of the invention. For example, the rowing machine of this invention may be structured with just one wide rail as is typical of many rowing machines on the market. Other methods of providing resistance to the motion of the fulcrum bar such as the use of springs and weights are known and obvious.

I claim:

1. An exercise machine of the rowing type having a track, a seat that rolls on the track and a footrest at the end of said track, which further comprises;

a right fulcrum bar having a first end hingeably attached to a right side of said seat and a second end;

a left fulcrum bar having a first end hingeably attached to a left side of said seat and a second end;

a right resistance means having a first end with attachment means for hingeable attachment to said track near said footrest and a second end;

a left resistance means having a first end with hingeable attachment means for attachment to said track near said footrest and a second end;

means for hingeably attaching said second end of said right resistance means to said right fulcrum bar at a location on said right fulcrum bar whose distance from said first end of said right fulcrum bar may be adjusted;

means for hingeably attaching said second end of said left resistance means to said left fulcrum bar at a location on said left fulcrum bar whose distance from said first end of said left fulcrum bar may be adjusted;

so that a user may sit on said seat with his feet on said footrest and grasp each said fulcrum bar near said second end and exercise by straightening his knees and hips and pulling with his arms whereby the ratio of force exerted by the arms and back to the force exerted by the knees to overcome resistance presented by the resistance means depends on said locations of said means for attaching said second ends of said resistance means to said fulcrum bars respectively and further whereby the resistance means force varies with movement of said seat which is coupled thereto by said fulcrum bars.

2. An exercise machine as in claim 1 which further comprises:

a back support hingeably attached to said seat along an edge of said seat distal fartherest from said footrest;

a brace rigidly attached to said backrest and extending under said seat so that rotation of said backrest is limited between a position where said backrest is lying horizontally on said seat to an erect position where said brace prevents further rotation of said backrest away from said horizontal position by contact of said brace with an underside of said seat;

so that when said backrest is erect, the user may sit on said seat with his feet on said footrest and his back against said backrest to perform leg presses and when said back rest is horizontal and lying on said seat, the user may sit on said backrest with his feet on said footrest and straighten his hips completely to perform rowing and situp exercises.

3. An exercise apparatus as in claim 1 which further comprises:

said resistance means is a ram having a tube with a cap on first and second ends and said tube which contains oil and a plunger having a first side facing said first end and a second side to which is attached the first end of a first rod extending out through a hole in said cap of said second end and said first rod having a second end;

said means for attachment of said first end of said resistance means to said track is a pin attached to said track and extending horizontally and perpendicular to said track and a collar hingeably positioned on said pin and perpendicularly attached to a first end of a bar whose other end is attached to said cap on said first end of said cylinder;

said means for attaching said second end of said resistance means to said adjustable location on said fulcrum bar being a collar which slides on said fulcrum bar and a yoke hingeably attached to said collar by a pin through each leg of said yoke attached perpendicularly to said collar and wherein said yoke is attached to said second end of said rod at its center so that the legs of said yoke are parallel to said rod;

so that when the exercise is performed, said plunger moves back and forth in said cylinder causing oil to flow from one side of the plunger to the other side to provide resistance to the performance of the exercise

4. An exercise apparatus as in claim 3 wherein said ram further comprises:

said plunger having a first and second orifice both having openings on said first and second surfaces;

said first rod having a thread on a portion of its length which extends to outside said tube;

a sleeve threaded onto said threaded portion and extending through a hole in said second cap where it has an end;

a first spring whose first end is in contact with said end of said first sleeve and having a second end;

a first flap whose first side is in contact with said second end of said spring and having a second side which is held in contact with said second surface of said plunger and covers said opening of said first orifice when no oil is forced to flow through said first orifice from said first surface to said second surface of said plunger but compresses said first spring and uncovers said opening of said first orifice to allow pressurized oil to flow from said first surface to said second surface through said first orifice;

a second flap attached to said first side of said plunger which covers said opening of said second orifice which blocks oil from flowing from said first surface through said second orifice to said second surface but permits oil to flow freely from said second side through said second orifice to said first side.

5. A ram as in claim 4 which further comprises:

a second rod attached to said first surface of said plunger and extending out of said tube through a hole in said first cap and having a threaded portion on a length of rod outside said tube;

a second sleeve threaded onto said threaded portion of said second rod and extending through said hole in said first cap and having an end inside said tube;

a second spring having a first end in contact with said end of said second sleeve and having a second end which contacts said second flap;

so that in order for oil to flow from said second surface to said first surface of said plunger through said second orifice, oil pressure on said second surface must cause said second flap to compress said second spring with a force determined by the position of said second sleeve on said threaded portion of second rod.

* * * * *